United States Patent [19]

Brackmann et al.

[11] 4,233,996

[45] Nov. 18, 1980

[54] CUTTING LEAF TOBACCO

[75] Inventors: Warren A. Brackmann, Cooksville; Daniel DiIanni, Toronto, both of Canada

[73] Assignee: Rothmans of Pall Mall Canada Limited, Toronto, Canada

[21] Appl. No.: 40,487

[22] Filed: May 21, 1979

[30] Foreign Application Priority Data

May 23, 1978 [GB] United Kingdom ..... 21640/78

[51] Int. Cl.[3] ..... A24B 5/00

[52] U.S. Cl. ..... 131/140 R

[58] Field of Search ..... 131/131, 140, 146, 145, 131/149

[56] References Cited

U.S. PATENT DOCUMENTS 3,128,775 4/1964 Eissmann ..... 131/146

3,219,042 11/1965 Molins ..... 131/140 R 3,369,552 2/1968 Carroll ..... 131/2

FOREIGN PATENT DOCUMENTS 1195163 6/1970 United Kingdom ..... 131/146 X

*Primary Examiner*—Stephen C. Pellegrino

*Attorney, Agent, or Firm*—Sim & McBurney

[57] ABSTRACT

Leaf tobacco is processed to form cut tobacco suitable for direct formation of cigarettes therefrom. The leaf is cut into shreds dimensioned for direct use in cigarette rod-forming, the shreds are air classified into a heavier stem containing fraction and a lighter stem-free lamina fraction, the heavier fraction is threshed to separate lamina from associated stem, and the separated lamina and lighter fraction are mixed. The procedure results in an improved rod-forming feed quality.

8 Claims, 1 Drawing Figure

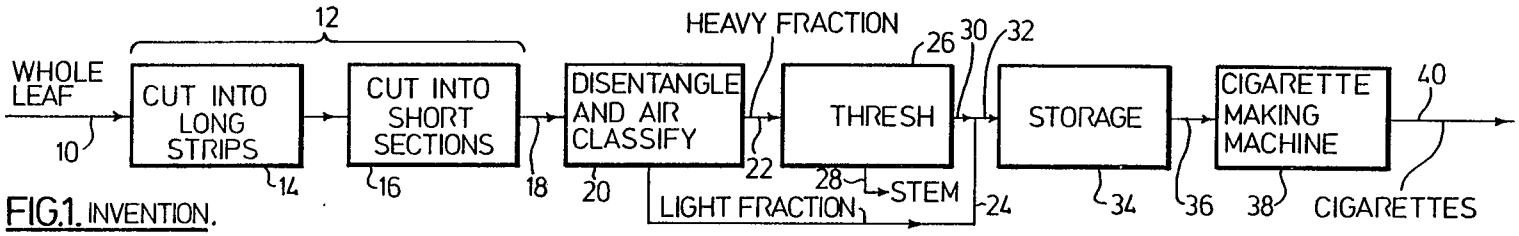
FIG.1. INVENTION.
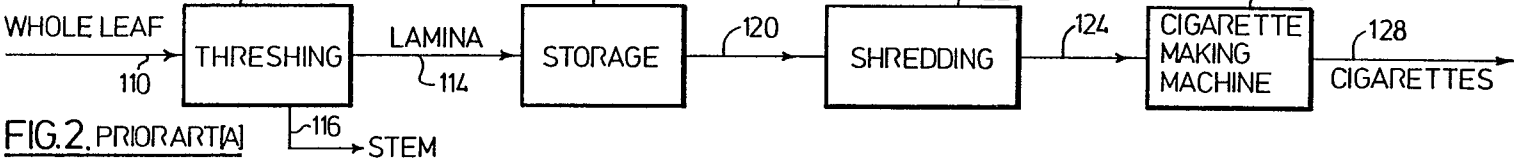
FIG.2. PRIOR ART [A]
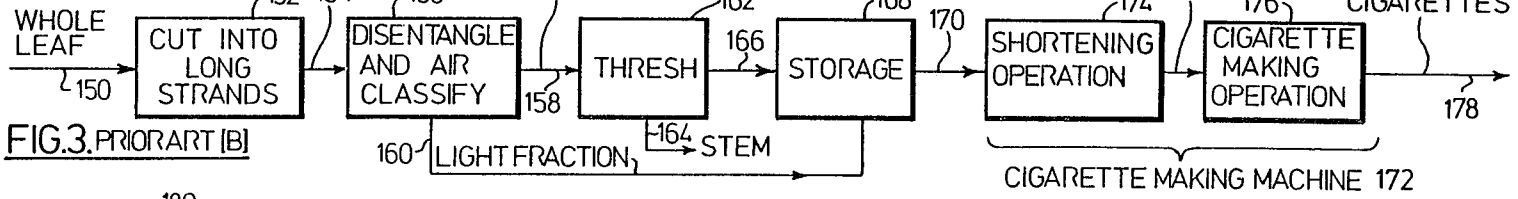
FIG.3. PRIOR ART [B]
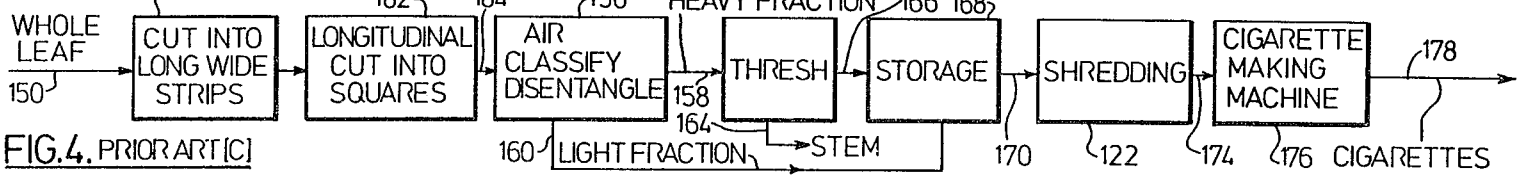
FIG.4. PRIOR ART [C]

CUTTING LEAF TOBACCO

FIELD OF INVENTION

The present invention is directed to cutting leaf tobacco, particularly cutting whole leaf tobacco for feed to a cigarette making process.

BACKGROUND TO THE INVENTION

In one conventional and widely used leaf tobacco cutting procedure for the separation of tobacco lamina from stem material, the tobacco leaves are threshed and thereby the lamina are torn from the stem material. The tobacco lamina and stem then are separately stored for periods up to 2 years or longer. When desired to be used in cigarette making, the tobacco lamina are removed from storage and cut or shredded to the size desired in the cigarette making machine. The stored stem also may be used and, for this purpose, usually is flattened, cut and mixed in with the shredded tobacco to provide the cigarette making machine feed.

The threshing procedure which is effected in this prior art operation causes considerable damage to the tobacco, with large numbers of fines being formed. Large numbers of such fines are detrimental to the filling power of the tobacco and hence the net result of the threshing procedure is a decreased filling power of the tobacco in the cigarettes ultimately formed therefrom.

Another prior art procedure which has been used involves cutting the whole tobacco leaf transversely into long narrow strips or strands, disentangling the resultant mass and air separating the disentangled mass to separate heavier lamina strands containing stem particles from lighter lamina strands free from stem particles. Thereafter, threshing is effected on the heavier lamina strands to separate lamina and stem. The recovered lamina are passed to storage for subsequent feed to the cigarette making machine wherein the tobacco is shortened to the desired strand length prior to formation into cigarettes.

This procedure suffers from the drawbacks that the disentangling operation is not easily effected owing to the strand length of the tobacco and involves considerable tearing and hence degradation of the tobacco, that the air separation operation is inaccurate in achieving separation of stem from lamina owing to the large strand length of the particles being separated, and that strand shortening is required to be effected by the cigarette making machine.

A third prior art procedure, described in U.S. Pat. No. 3,128,775 involves subjecting the tobacco leaves to an initial transverse cut and then to a longitudinal cut to form a plurality of square or rectangularly-shaped tobacco pieces. These tobacco pieces are classified into a heavier fraction from having stem associated therewith and a light lamina fraction, the heavier fraction is subjected to threshing to separate the stem, and the light fraction lamina and the threshed lamina are stored. When required for use, the lamina is shredded to the desired shred size and passed to the cigarette making machine.

The latter procedure is an improvement on other prior art operations in that the individual tobacco pieces resulting from the cutting operation are much smaller and hence more readily separated and air classified. However, the latter procedure requires a separate shredding operation to be effected prior to passage of the tobacco to the cigarette making machine and the tobacco leaves must be smooth and flat for effective cutting to occur. Two separate cutting operations are used, necessitating complicated equipment.

SUMMARY OF INVENTION

The present invention provides an improved tobacco leaf-cutting operation which has decreased drawbacks with respect to the prior art.

In the present invention, at least a substantial proportion of the leaf, preferably the whole leaf, is cut into tobacco particles or shreds of cigarette rod-forming dimensions, the tobacco particles resulting from the cutting operations are classified, preferably by air separation, to remove the heavier particles having stem associated therewith from the lighter lamina particles, the heavier particles usually are threshed to separate the stem from lamina particles connected thereto, and the lamina particles resulting from the threshing usually are mixed with the lighter lamina particles resulting from the classification to provide tobacco particles which are suitable for direct formation of cigarettes therefrom without the necessity for further shredding or shred shortening operations. The tobacco particles may be stored, as desired, and mixed with processed tobacco stem, as described above, if desired.

The procedure of this invention minimizes the proportion of the tobacco leaves which must be subjected to threshing and hence minimizes filling power damage resulting from such threshing. In addition, the tobacco particles which result from the cutting, separating and threshing steps are sized for direct feed to cigarette making without the necessity for further manipulation procedures involving shortening, so that further degradation which results therefrom is avoided.

BRIEF DESCRIPTION OF DRAWINGS

FIG. 1 is a schematic flow sheet of a tobacco leaf processing operation in accordance with the present invention; and FIGS. 2 to 4 are schematic flow sheets of prior art tobacco leaf processing procedures.

DESCRIPTION OF PREFERRED EMBODIMENT

Referring to FIG. 1, tobacco leaves, usually conditioned using conventional moistening procedures, are fed by line 10 to a cutting operation 12 which includes longitudinally cutting the leaf at 14 with cuts spaced apart the length of shreds of rod-forming dimensions and transversely cutting the leaf at 16 with cuts spaced apart the width of shreds of rod-forming dimensions. These cutting steps may be effected in either order sequentially, or preferably substantially simultaneously. Simultaneous longitudinal and transverse cutting may be affected using equipment described in U.K. Pat. No. 1,195,163, suitably modified for tobacco leaf, as opposed to the tea leaf described in that patent.

The sequence of operations which is effected is intended to be continuous, so that a plurality of individual leaves or a plurality of multiple numbers of leaves are sequentially subjected to the cutting operation.

The cutting operations at 14 and 16 are effected to form tobacco particles of shred size, i.e. of a size normally used in cigarette rod formation during cigarette making. The dimensions of such shreds may vary, but within fairly narrow limits common to the cigarette making industry. Preferably the shreds have a length of about 0.5 to about 0.75 inches (about 1.3 to about 1.9 cm), a width of about 0.02 to about 0.05 inches (about 0.05 to about 0.13 cm), and a depth which is the natural thickness of the leaf.

The cut tobacco particles resulting from cutting operation 12 then is forwarded by line 18 to a classification operation 20. The cut tobacco particles are usually obtained from the cutting operation as a tangled mass and a disentangling operation is effected thereon prior to classification, to facilitate the classification operation. Since the tobacco particles in the tangled mass are of relatively short strand length, the disentangling is readily effected without substantial degradation of the tobacco.

Air classification of the disentangled tobacco particles produces a heavy fraction in line 22 and a light fraction in line 24. The classification is effective since those tobacco particles having stem associated therewith are heavier than other lamina particles, so that the heavy fraction obtained has the stem portion of the leaf associated therewith. The short strand dimension of the particles classified results in a substantially complete separation of the particles into stem associated- and lamina-particles.

The proportion of the tobacco particles obtained as the heavy fraction generally does not exceed about 20% of the cut tobacco particles, and usually is about 5 to about 15%, depending on the initial leaf dimensions and the shred dimensions.

The heavy fraction in line 22 is subjected to threshing at 26 to separate lamina from associated stem, the stem being removed by line 28 and the lamina by line 30. the stem may be subjected to processing by any desired procedure conventional to cigarette making, such as, flattening, cutting and mixing with cigarette machine feed tobacco.

The lamina recovered from the threshing operation in line 30 usually is mixed with the light fraction from the classification to provide a substantially stem-free mixture of tobacco shreds in line 32. This mixture is ready for direct use in a cigarette making operation without further shredding or shred shortening.

Since only a minor proportion of the tobacco in the initial leaf is subjected to threshing in this procedure, the proportion of tobacco exposed to degradation thereby is minor. While some degradation of the tobacco occurs in the threshing operation, such degradation is minimized since only that proportion of the initial cut tobacco which has stem associated therewith is threshed.

The tobacco particles in line 32 usually are forwarded to storage 34, usually after drying. When required for the making of cigarettes, the tobacco is removed from storage 34 and passed by line 36 directly to a cigarette making machine 38, without subjecting the same to further cutting or shredding operations, to form cigarettes in line 40. In addition, the cigarette making machine 38 does not need to effect shred shortening therein. The stored tobacco usually is subjected to conditioning, using conventional moistening procedures, and may be mixed with processed stem material, prior to passage to the cigarette making machine 38.

The tobacco particles in line 32 may be fed directly to the cigarette making machine 38, if desired, in those cases where storage of the tobacco is not required or is undesirable. The drying and reconditioning operations also are omitted in the latter procedure.

The procedure of the present invention as just described with reference to FIG. 1 contrasts markedly with known prior art procedures and results in a superior tobacco feed for cigarette making. The improvements over the prior art are described with reference to FIGS. 2 to 4 which illustrate three known prior art approaches to the formation of cigarettes from leaf tobacco. For ease of description with respect to the prior art procedures, the conditioning, drying and reconditioning operations are not described, although it will be understood by those skilled in the art that these operations are routinely effected. Further, a storage operation is described below for each prior art procedure. As in the case of the invention, such storage may be omitted when it is desired to utilize the tabacco immediately in cigarette making.

in the prior art operation of FIG. 2, whole leaf in line 110 is all subjected to threshing at 112 to separate lamina removed by line 114 from stem removed by line 116. The lamina is forwarded to storage 118. When required for use the tobacco is removed from storage 118 and forwarded by line 120 to a shredding operation 122 to form shreds of desired size. The shreds resulting from the latter operation of a size suitable for formation of cigarettes are forwarded by line 124 to a cigarette making machine 126 to result in cigarettes in line 128.

This prior art procedure, therefore, subjects all the tobacco leaf to threshing which results in considerable degradation of all the lamina, although stem is effectively removed. In contrast, in the present invention, only a minor proportion of the tobacco is subjected to such threshing and hence the degradation resulting therefrom, and the consequential loss of filling power, is considerably decreased with respect to this prior art procedure.

Further, the threshed tobacco leaf must be subjected to further shredding to form tobacco shreds of size suitable for machine feed whereas in the present invention, the tobacco leaf is cut to rod-forming size shreds prior to the threshing and further shredding or cutting of the threshed tobacco is not required, and the degradation associated with further manipulation of the tobacco is avoided.

The prior art procedure of FIG. 3 represents an attempt to overcome the problem of threshing all the leaf associated with the procedure of FIG. 2. In the procedure of FIG. 3, the tobacco leaf in line 150 is cut transversely at 152 into longitudinal strips or strands of width corresponding approximately to the width of tobacco particles ultimately required. The cutting operation results in a tangled mass of relatively long tobacco strands which is forwarded by line 154 to disentanglement and air classification at 156.

The air classification results in a heavy tobacco strand fraction in line 158 and a light tobacco strand fraction in line 160. The heavy tobacco strand fraction in line 158 is subjected to threshing at 162 to separate stem in line 164 and to provide substantially stem-free lamina in line 166. The stem-free lamina in line 166 and the light tobacco strand fraction in line 160 are forwarded to storage 168.

When it is desired to utilize the tobacco, the tobacco is removed from storage 168 by line 170 and forwarded to a cigarette making machine 172, wherein provision is made for shortening of the long tobacco strands to the desired length at 174 for cigarette formation at 176, thereby to provide cigarettes in line 178.

While the cutting of the tobacco leaf into longitudinal strands decreases the proportion of the leaf subjected to threshing, as compared with the procedure of FIG. 2, nevertheless the prior art procedure of FIG. 3 possesses problems which are overcome by the procedure of this invention.

The length of the tobacco strands in the tangled mass resulting from the cutting operation renders effective separation difficult to perform. Additionally, the force required to achieve any significant degree of separation of the tangled mass results in the formation of tobacco fines, as a result of degradation of the strands.

In the procedure of the present invention, the tobacco leaf is first cut into shreds of a rod-forming size. The relatively short strand length of these tobacco particles renders disentanglement relatively simple to perform with little or no fines formation from tobacco particle degradation and consequential loss of filling power.

The relatively long strand length of the tobacco strips formed in the prior art cutting operation and the often low efficiency of disentanglement of the strands lead to imperfect separation of the strands into the heavier fraction stem associated lamina strands in line 158 and the lighter fraction lamina strands in line 160. Such imperfect separation results in the presence of lamina having stem associated therewith in the lighter fraction stream and the presence of lamina having no stem associated therewith in the heavier fraction stream.

Both conditions are undesirable, since the stem-associated lamina in the light fraction stream avoid threshing and hence stem removal, and the lamina having no stem associated therewith in the heavy fraction stream is subjected to unnecessary threshing and degradation.

These undesirable features are absent from the procedure of this invention. The relatively short length of tobacco strands in this invention allows efficient air classification, so that substantially all the stem-associated lamina are forwarded to threshing and substantially all the non-stem-associated lamina by-pass threshing.

The prior art procedure of FIG. 3 retains the shredding operation of the FIG. 2 procedure. As noted above, this procedure is rendered unnecessary in this invention by initially cutting the leaf to shred size.

FIG. 4 represents an attempt to improve upon the prior art of FIGS. 2 and 3. Many of the operations in FIG. 4 are common to the procedure of FIG. 3 and the same reference numerals have been used with respect thereto. The procedure of FIG. 4 differs from that of FIG. 3 with respect to the initial leaf cutting operations.

In the procedure of FIG. 4, the tobacco leaf fed by line 150 is subjected first to cutting at 180, transversely of the leaf to form a plurality of wide strips and the strips are then cut at 182 in a separate operation longitudinally of the strips to form tobacco squares, which then are forwarded by line 184 to disentanglement and air classification at 156.

While the latter procedure improves upon the procedure of FIG. 3 since the tobacco leaf is formed into smaller individual tobacco pieces than the relatively long strands of the FIG. 3 procedure and hence disentanglement is simpler to perform and less tobacco degradation results, the tobacco squares formed in this cutting operation are required to be shredded prior to use to the required shred size in shredder 122, in contrast to the procedure of the invention.

The regular character of the shape of the tobacco particles results in degradation and fines formation during such shredding owing to random exposure of the tobacco particles to the cutting blades in the shredder. In the present invention, the tobacco is cut into rod-forming size shreds prior to air classification and hence such degradation and associated loss of filling power are avoided.

In addition, for effective operation of the cutting procedure adopted in FIG. 4, the individual tobacco leaves must lie flat and adjacent one another on a flat surface. However, tobacco leaves are often bent, folded on themselves and generally is not conducive to an ordered flat array such as required in this procedure. Considerable prior manipulation of the leaves, therefore, is required to prepare them for this cutting operation. Such manipulative operations are not required in this invention.

In addition, the proportion of the leaf which is subjected to threshing in the procedure of FIG. 4 is usually in excess, and often considerably in excess, of the proportion subjected to threshing in this invention. The proportion which is subjected to threshing in this prior art depends on the size of the cut tobacco squares and the degree of adherence to a flat orientation of the tobacco leaves, and usually exceeds about 25% and is typically about 50%.

It is apparent, therefore, from the immediately preceding discussion of the prior art procedures of FIGS. 2 to 4 and their relationship to the procedure of the invention, that the present invention produces cut tobacco from tobacco leaves suitable for making machine feed of improved quality in terms of filling power in an improved manner.

SUMMARY OF DISCLOSURE

In summary of this disclosure, the present invention provides a procedure of manipulation of tobacco leaves by cutting, classifying into heavy and light fractions, and threshing the heavy fraction to separate stem, to form tobacco particles suitable for direct formation of cigarettes without further processing. Modifications are possible within the scope of the invention.

What we claim is:

1. A method of forming cigarettes from leaf tobacco, which comprises:

cutting at least a substantial proportion of the tobacco leaf into a plurality of shreds of tobacco by substantially simultaneously subjecting said leaf to a plurality of longitudinal cuts of width about 0.5 to about 0.75 inches to establish the length of said shreds and to a plurality of transverse cuts of width about 0.02 to about 0.05 inches to establish the width of said shreds, separating said plurality of shreds into a heavier fraction of shreds containing substantially all of said plurality of shreds having leaf stem associated with lamina in an amount which is no more than 20% of said shreds and a lighter fraction of shreds containing substantially all of said plurality of shreds consisting of lamina not having leaf stem associated therewith, threshing said heavier fraction to separate said leaf stem from the lamina portions associated therewith, recovering said lamina portions and mixing the same with said lighter fraction to form a cigarette rod-forming operation feed, and forming cigarettes directly from said feed.

2. The method of claim 1, wherein the whole of the tobacco leaf is subjected to said cutting.

3. The method of claim 1 wherein said heavier fraction of shreds contains about 5 to 10% of said plurality of shreds.

4. The method of claim 1, 2 or 3 including disentangling said plurality of shreds prior to said separation step.

5. The method of claim 1 wherein said separation step is effected using air classification.

6. The method of claim 1 including the additional steps of:

drying said cigarette making operation feed to a moisture level suitable for storage, storing said dried feed for a desired period of time, conditioning said stored dried feed to a desired moisture level following said desired period of time, and utilizing said latter conditioned feed in said cigarette forming step.

7. A method of forming cigarettes from leaf tobacco, which comprises:

conditioning leaf tobacco to a desired moisture content, cutting said conditioned leaf tobacco into a plurality of shreds of tobacco as a tangled mass by substantially simultaneously subjecting said leaf to a plurality of longitudinal cuts of width about 0.5 to about 0.75 inches to establish the length of said shreds and to a plurality of transverse cuts of width about 0.02 to about 0.05 inches to establish the width of said shreds, disentangling said tangled mass, air classifying said disentangled mass to provide a heavier fraction of shreds containing substantially all of said plurality of shreds having leaf stem associated therewith in an amount which is no more than 20% of said disentangled mass and a lighter fraction of shreds containing substantially all of said plurality of shreds not having leaf stem associated therewith in an amount which is the remainder of said disentangled mass, threshing said heavier fraction to separate said leaf stem from the lamina portions associated therewith, recovering said lamina portions and mixing the same with said lighter fraction to form a cigarette rod-forming operation feed, and forming cigarettes directly from said feed.

8. The method of claim 1 or 6 wherein the stem resulting from said threshing step is flattened, cut and mixed with said tobacco feed to said cigarette forming step.

* * * * *